US005816695A

United States Patent [19]

Lin

[11] Patent Number: 5,816,695

[45] Date of Patent: Oct. 6, 1998

[54] CANDLESTICK TYPE LAMP

[76] Inventor: Mei-Lu Lin, 56, Min Sheng Street, Fengyuan, Taichung Hsien, Taiwan

[21] Appl. No.: 979,707

[22] Filed: Nov. 27, 1997

[51] Int. Cl.[6] ..... F21V 35/00

[52] U.S. Cl. ..... 362/392; 362/204; 362/205

[58] Field of Search ..... 362/204, 205, 362/392, 393

[56] References Cited

U.S. PATENT DOCUMENTS

| | | | |
|---|---|---|---|
| 4,484,253 | 11/1984 | Roberts | 362/206 |
| 5,158,357 | 10/1992 | McDermott | 362/204 |
| 5,601,360 | 2/1997 | Paquette | 362/226 |

*Primary Examiner*—Stephen F. Husar

[57] ABSTRACT

A candlestick type lamp has a base seat, a pipe, a plastic upper seat, a bulb, an extended conductive plate disposed in the pipe, and the conductive plate having a hook-shaped conductive plate and a lower disk end receiving a metal spring. The bulb has a screw base and a tip end. The plastic upper seat has an inner thread, a through hole, and an outer thread. The pipe has an inner threaded upper end engaging with the outer thread and a slide groove receiving the extended conductive plate. A cell is disposed between the metal spring and the tip end. The screw base engages with the inner thread. The hook-shaped conductive plate contacts the bottom of the screw base. The upper end of the conductive plate contacts a periphery of the screw base.

3 Claims, 7 Drawing Sheets

CANDLESTICK TYPE LAMP

BACKGROUND OF THE INVENTION

This invention relates to a candlestick type lamp, and more particularly, this invention relates to a candlestick type lamp which can be conducted effectively.

Referring to FIGS. 1 and 2, a conventional candlestick type lamp comprises a base seat 15, a pipe 10 disposed on the base seat 15, a plastic upper seat 11 disposed on the pipe 10, a bulb 12 disposed on the plastic upper seat 11, a conductive plate 13 disposed in the pipe 10, and the conductive plate 13 having a disk end 131 receiving a metal spring 132. The pipe 10 has a threaded upper end 102 and a slide groove 101 receiving the conductive plate 13. The plastic upper seat 11 is plated by a layer of metal. A cell 14 is disposed between the metal spring 132 and the plastic upper seat 11. The metal layer may be fallen down after a long period of usage. Since the plastic upper seat 11 should be rotated in order to replace the cell 14 or the bulb 12, the metal layer will be worn out easily.

SUMMARY OF THE INVENTION

An object of this invention is to provide a candlestick type lamp which can be conducted effectively.

DETAILED DESCRIPTION OF THE INVENTION

Figure 1:
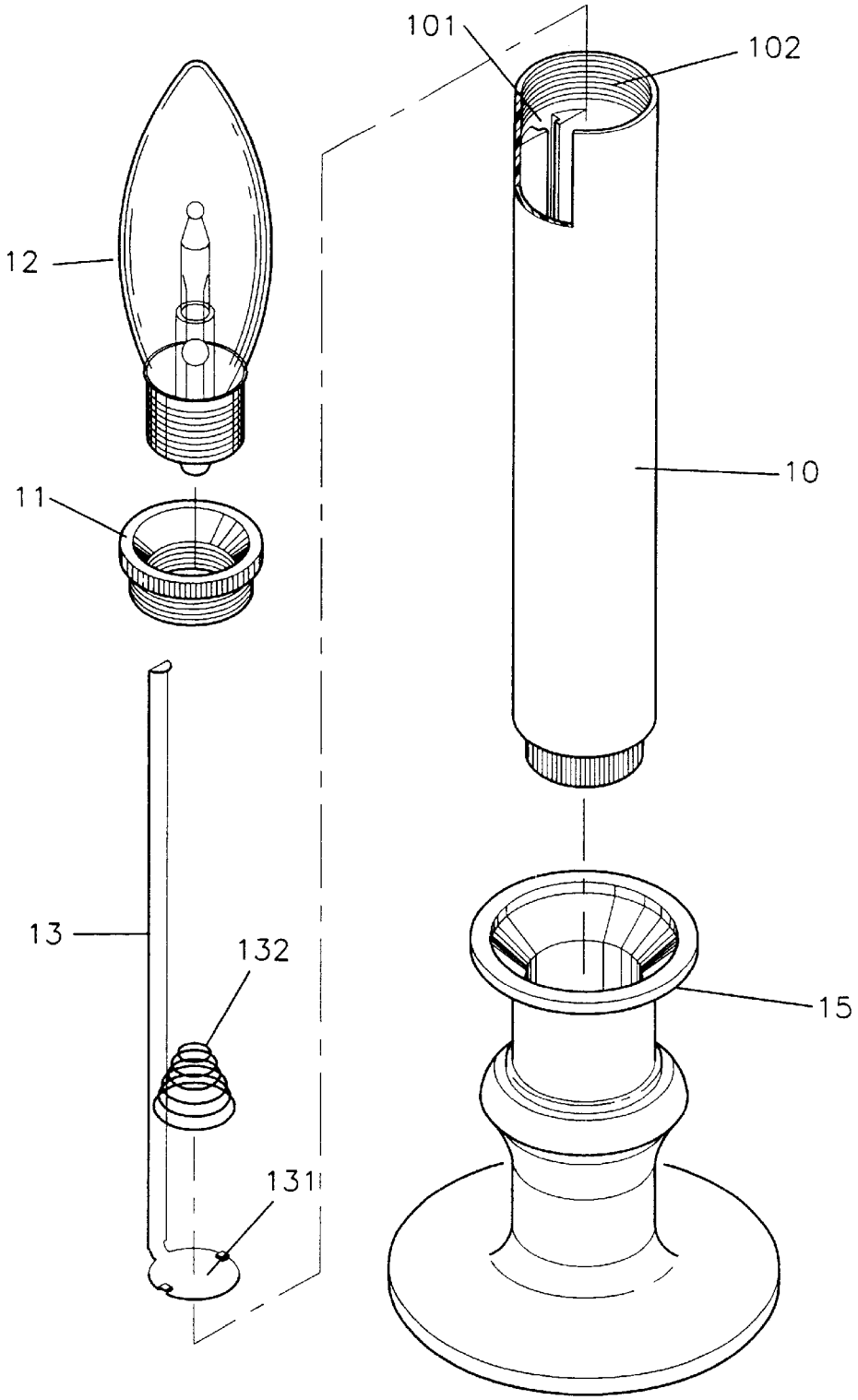
FIG. 1 Prior Art
FIG. 1 is a perspective exploded view of a candlestick type lamp of the prior art.
Figure 2:
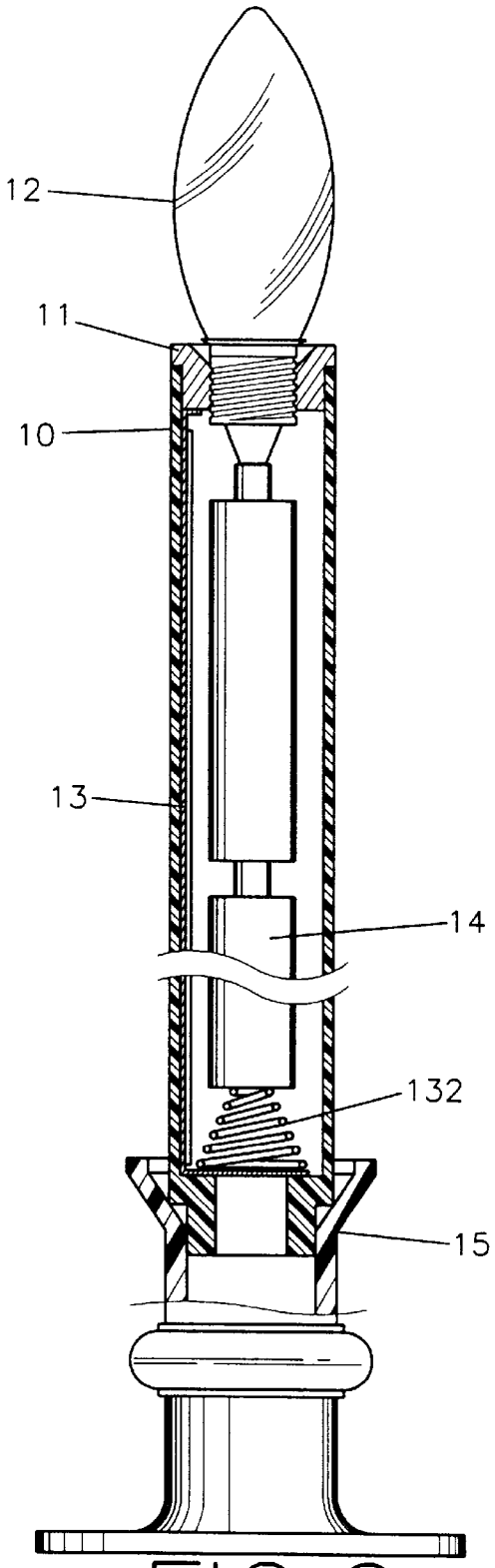
FIG.2 Prior Art
FIG. 2 is a sectional assembly view of FIG. 1.
Figure 3:
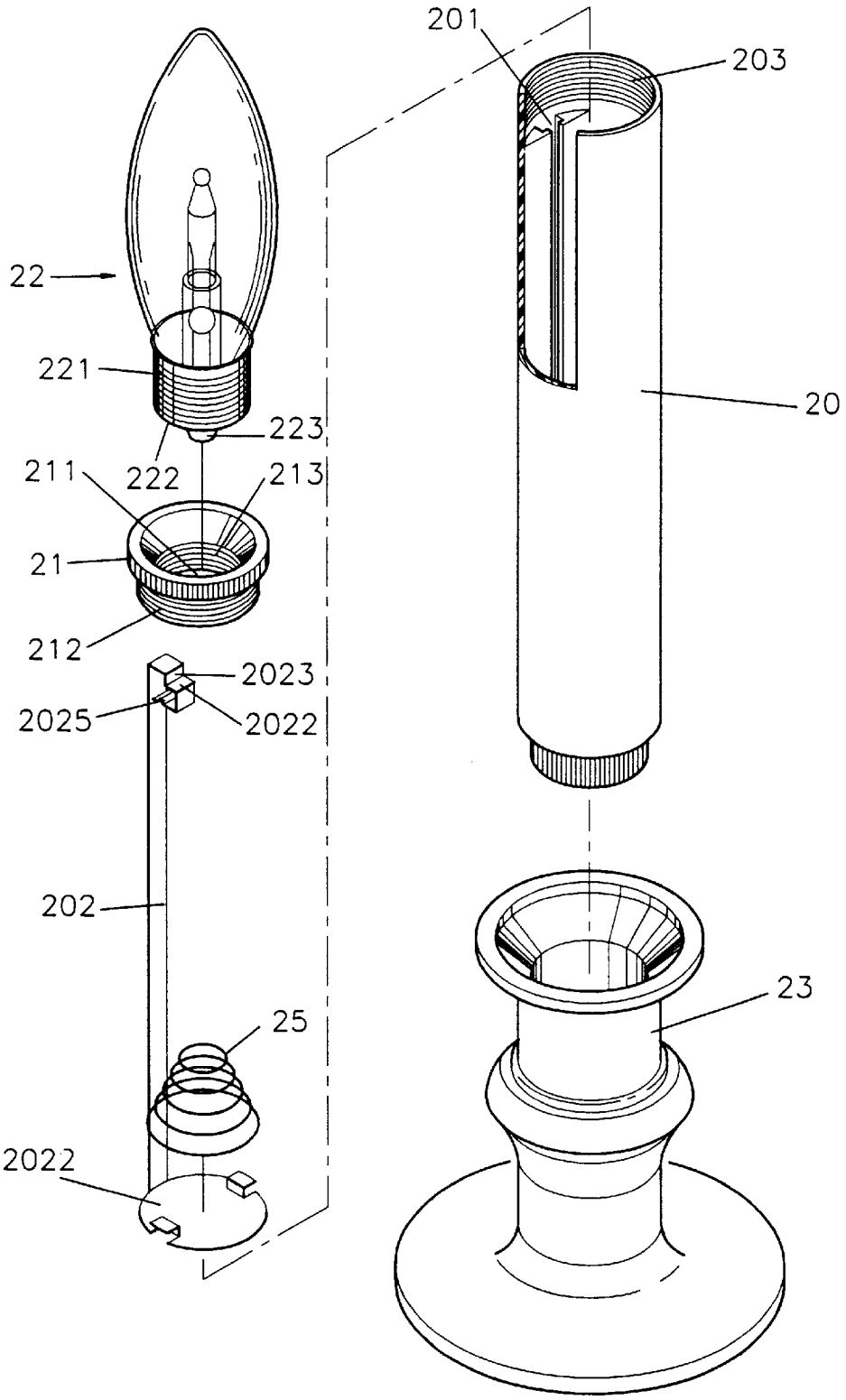
FIG. 3 is a perspective exploded view of a candlestick type lamp of a preferred embodiment.
Figure 4:
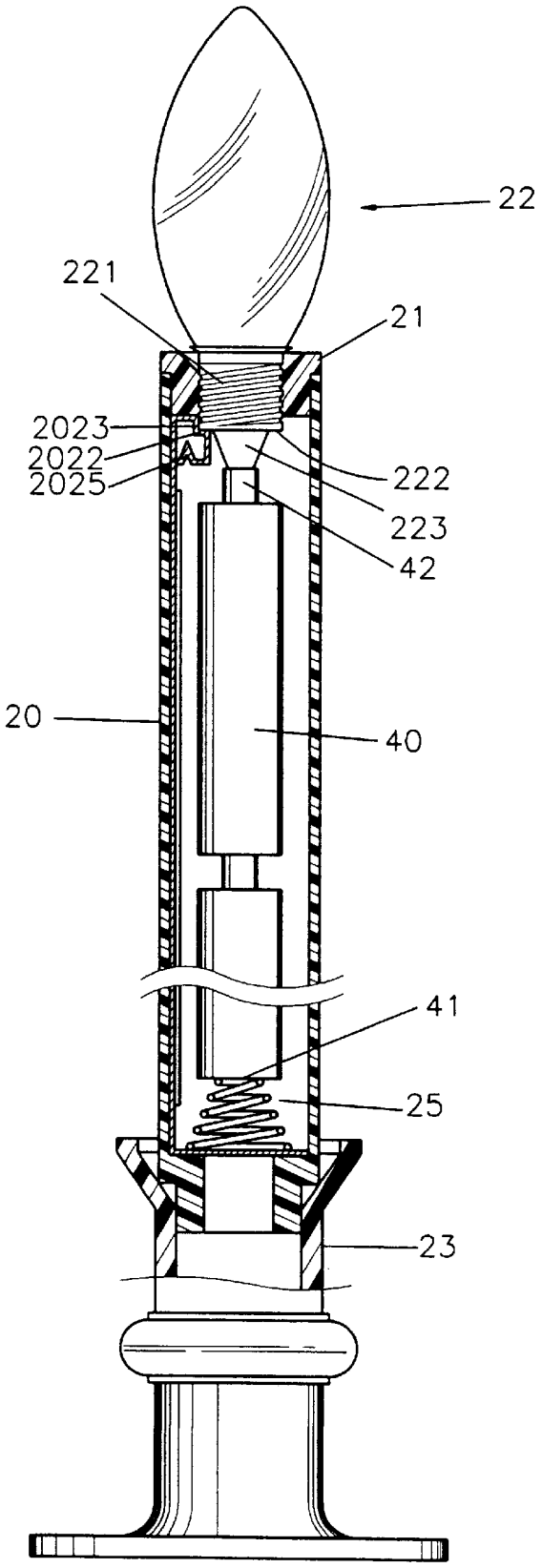
FIG. 4 is a sectional assembly view of FIG. 3.

Referring to FIGS. 3 and 4, a candlestick type lamp comprises a base seat 23, a pipe 20 disposed on the base seat 23, a plastic upper seat 21 disposed on the pipe 20, a bulb 22 disposed on the plastic upper seat 21, an extended conductive plate 202 disposed in the pipe 20, and the conductive plate 202 having a hook-shaped conductive plate 2022 disposed on an upper end 2023 of the conductive plate 202, and a lower disk end 2020 receiving a metal spring 25. The hook-shaped conductive plate 2022 has a curved tip 2025. The bulb 22 has a screw base 221, and a tip end 223 disposed on a bottom 222 of the screw base 221. The plastic upper seat 21 has an inner thread 213, a through hole 211, and an outer thread 212. The pipe 20 has an inner threaded upper end 203 engaging with the outer thread 212 and a slide groove 201 receiving the extended conductive plate 202. The plastic upper seat 11 need not be plated by a layer of metal. A cell 40 is disposed between the metal spring 25 and the tip end 223. The screw base 221 engages with the inner thread 213. The hook-shaped conductive plate 2022 contacts the bottom 222 of the screw base 221. The upper end 2023 of the conductive plate 202 contacts a periphery of the screw base 221.

Figure 5:
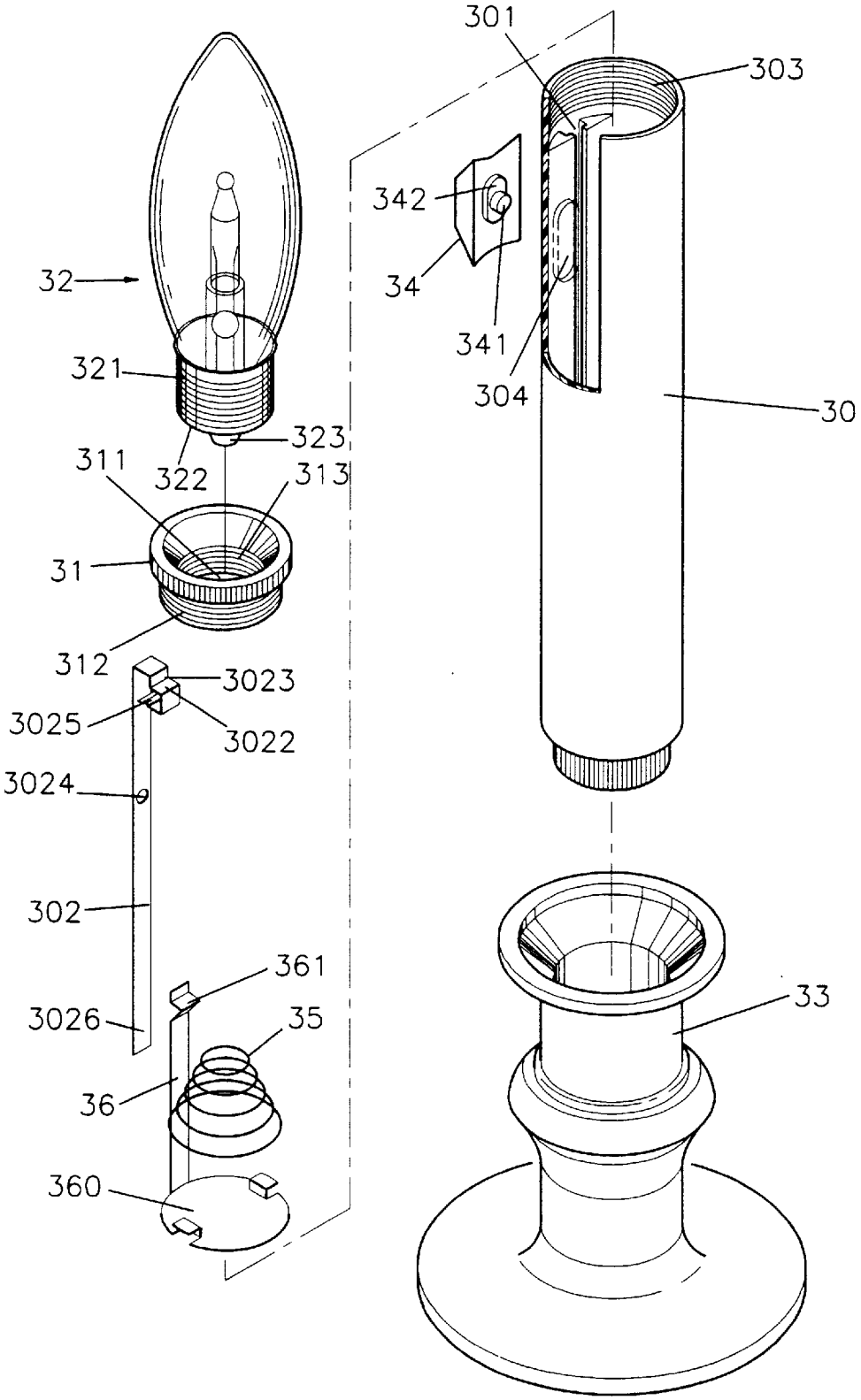
FIG. 5 is a perspective exploded view of a candlestick type lamp of another preferred embodiment.
Figure 6:
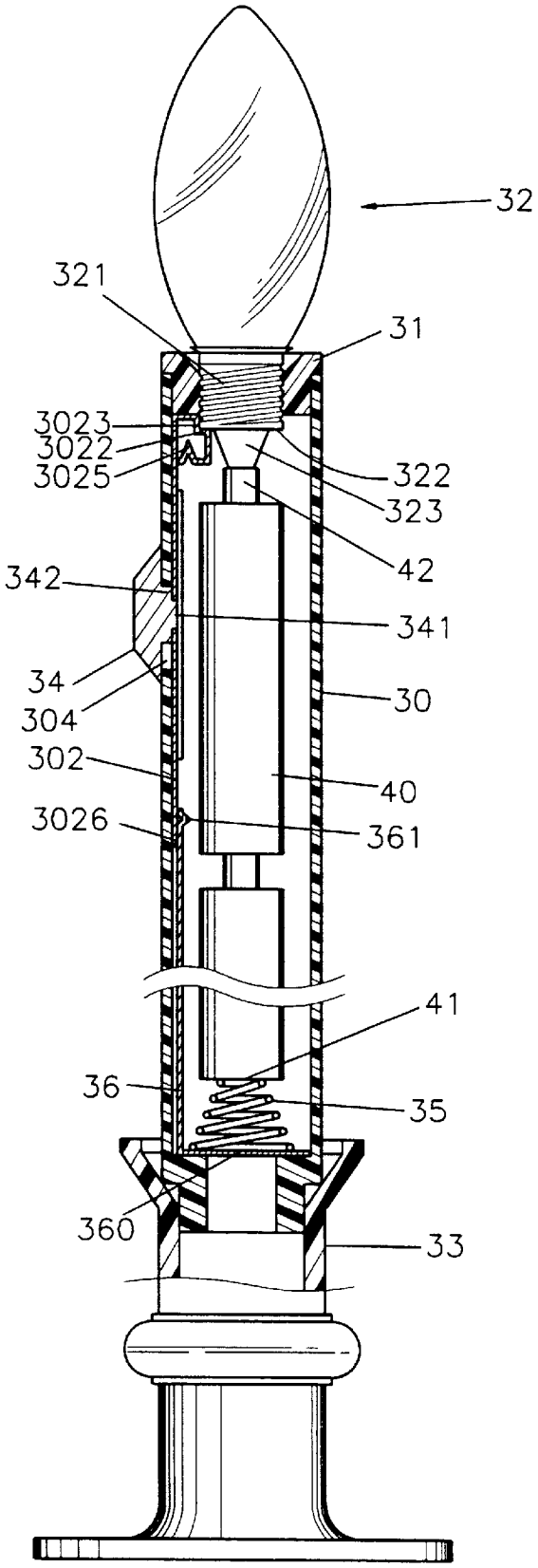
FIG. 6 is a sectional assembly view of FIG. 5.

Referring to FIGS. 5 and 6, another candlestick type lamp comprises a base seat 33, a pipe 30 disposed on the base seat 33, a plastic upper seat 31 disposed on the pipe 30, a bulb 32 disposed on the plastic upper seat 31, an upper conductive plate 302 disposed in the pipe 30, a lower conductive plate 36 disposed in the pipe 30, the upper conductive plate 302 having a round hole 3024 formed on a middle portion of the upper conductive plate 302 and a hook-shaped conductive plate 3022 disposed on an upper end 3023 of the upper conductive plate 302, and the lower conductive plate 36 having a lower disk end 360 receiving a metal spring 35 and an upper curved terminal 361 contacting a lower end 3026 of the upper conductive plate 302. The hook-shaped conductive plate 3022 has a curved tip 3025. The bulb 32 has a screw base 321, and a tip end 323 disposed on a bottom 322 of the screw base 321. The plastic upper seat 31 has an inner thread 313, a through hole 311, and an outer thread 312. The pipe 30 has an inner threaded upper end 303 engaging with the outer thread 312, a slide groove 301 receiving the upper conductive plate 302 and the lower conductive plate 36, and an oblong hole 304 receiving a slide block 34. The slide block 34 has a base plate 342, and a post 341 disposed on the base plate 342. The post 341 is inserted in the round hole 3024. The plastic upper seat 31 need not be plated by a layer of metal. A cell 40 is disposed between the metal spring 35 and the tip end 323. The screw base 321 engages with the inner thread 313. The hook-shaped conductive plate 3022 contacts the bottom 322 of the screw base 321. The upper end 3023 of the upper conductive plate 302 contacts a periphery of the screw base 321.

Figure 7:
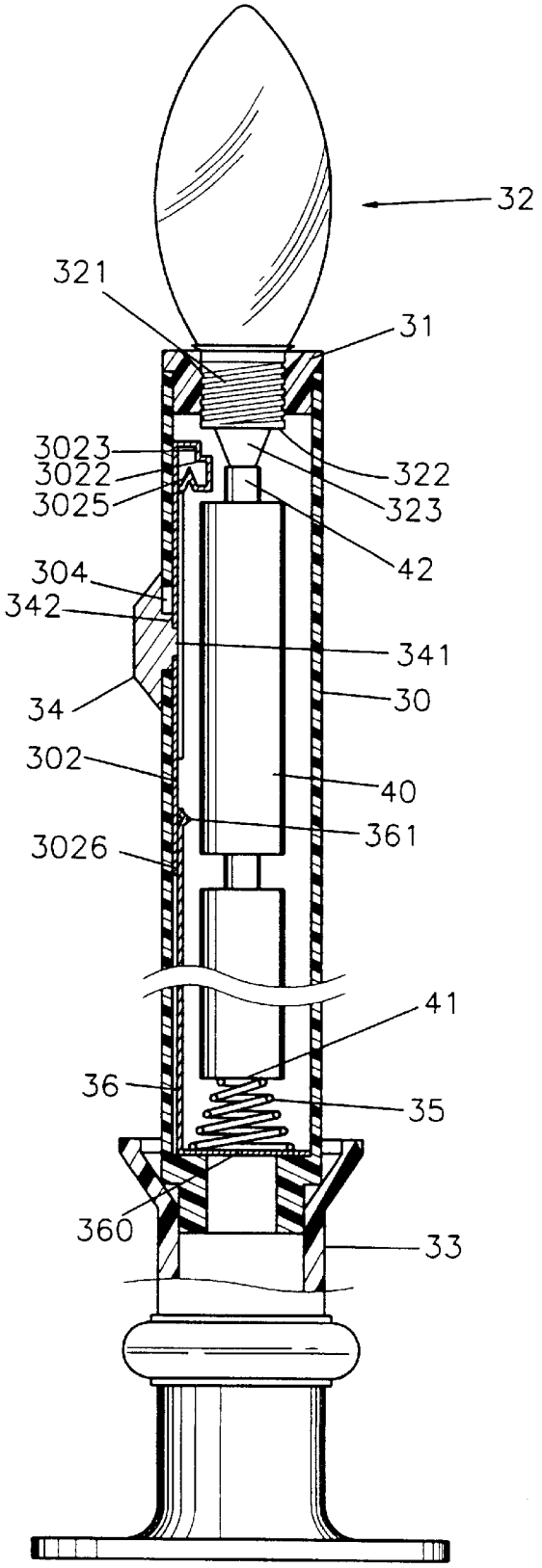
FIG. 7 is a schematic view illustrating an upper end of an upper conductive plate disconnecting from a screw base.

Referring to FIG. 7, the upper end 3023 of the upper conductive plate 302 disconnects from the screw base 321 while the slide block 34 is pressed downward.

I claim:

1. A candlestick type lamp comprises:

a base seat, a pipe disposed on the base seat, a plastic upper seat disposed on the pipe, a bulb disposed on the plastic upper seat, an extended conductive plate disposed in the pipe, the conductive plate having a hook-shaped conductive plate disposed on an upper end of the conductive plate, and a lower disk end receiving a metal spring, the hook-shaped conductive plate having a curved tip, the bulb having a screw base, and a tip end disposed on a bottom of the screw base, the plastic upper seat having an inner thread, a through hole, and an outer thread, the pipe having an inner threaded upper end engaging with the outer thread and a slide groove receiving the extended conductive plate, a cell disposed between the metal spring and the tip end, the screw base engaging with the inner thread, the hook-shaped conductive plate contacting the bottom of the screw base, and the upper end of the conductive plate contacting a periphery of the screw base.

2. A candlestick type lamp as claimed in claim 1, wherein the extended conductive plate has an upper plate and a lower plate.

3. A candlestick type lamp as claimed in claim 1, wherein the pipe further comprises an oblong hole receiving a slide block.

* * * * *